US006732459B1

(12) United States Patent
Clark

(10) Patent No.: US 6,732,459 B1
(45) **Date of Patent: *May 11, 2004**

(54) GREETING CARD WITH GIFT CARD HOLDER

(75) Inventor: Elyse Clark, Newtown, CT (US)

(73) Assignee: Kool Wraps, L.L.C., Newton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/293,476

(22) Filed: Nov. 14, 2002

(51) Int. Cl.[7] ..... B65D 85/57

(52) U.S. Cl. ..... 40/124.06; 40/124.19; 206/308.1

(58) Field of Search ..... 40/124.06, 124.08, 40/124.19; 206/308.1

(56) References Cited

U.S. PATENT DOCUMENTS

| | | | | |
|---|---|---|---|---|
| 1,855,822 | A | 4/1932 | Cahn | |
| 2,131,448 | A | 9/1938 | Lowen | |
| 2,367,967 | A | 1/1945 | Schwartz | |
| 2,417,982 | A | 3/1947 | Histed | |
| 2,749,657 | A | 6/1956 | Lohnes | |
| 3,191,328 | A | 6/1965 | Lohnes | |
| 3,225,474 | A | 12/1965 | Dusseau | |
| 3,353,657 | A | 11/1967 | Young | |
| 3,855,726 | A | 12/1974 | Yumoto | |
| 3,900,100 | A | 8/1975 | Girman | |
| 3,946,936 | A | 3/1976 | Brown | |
| 4,103,444 | A | 8/1978 | Jones et al. | |
| 4,313,270 | A | 2/1982 | Volkert et al. | |
| 4,360,106 | A | 11/1982 | Irvine et al. | |
| 5,004,271 | A | 4/1991 | Piatt | |
| 5,096,055 | A | 3/1992 | Opper | |
| 5,141,252 | A | 8/1992 | Michlin | |
| 5,450,680 | A | 9/1995 | Bromberg | |
| 5,692,671 | A | 12/1997 | Mussier et al. | |
| 5,799,424 | A | 9/1998 | Volkert et al. | |
| 5,884,770 | A | 3/1999 | Galm | |
| 5,933,989 | A | 8/1999 | Volkert et al. | |
| 5,943,800 | A | 8/1999 | Rose | |
| 5,947,281 | A | 9/1999 | Kaneff | |
| 5,971,157 | A | 10/1999 | Howell et al. | |
| 6,241,086 | B1 | 6/2001 | Bergh et al. | |
| 6,301,813 | B1 | 10/2001 | Volkert | |
| 6,418,648 | B1 * | 7/2002 | Hollingworth | 40/124.14 |
| 6,446,800 | B2 | 9/2002 | Bergh et al. | |
| 6,491,160 | B2 | 12/2002 | Butler et al. | |
| 6,493,970 | B1 | 12/2002 | McCarthy et al. | |
| 6,505,737 | B1 | 1/2003 | Sherman | |

FOREIGN PATENT DOCUMENTS

| | | |
|---|---|---|
| IT | 458834 | 8/1950 |

* cited by examiner

*Primary Examiner*—Cassandra H. Davis
(74) *Attorney, Agent, or Firm*—Dickstein Shapiro Morin & Oshinsky LLP

(57) ABSTRACT

A gift package includes a greeting card and an integrated gift card holder sized and shaped to receive a gift card such as that issued by various retail stores and restaurants, to provide a convenient, efficient and attractive way to present a recipient with a greeting card suited for the occasion. The gift package also includes a cover which covers a portion of the gift card holder. The gift card holder is movable between a first position relative to the cover when the greeting card is in a closed state, and a second position relative to the cover when the greeting card is in an opened state. When a gift card is placed in the gift card holder, at least a substantial portion of the gift card is displayed to a recipient from behind the cover when the greeting card is opened.

21 Claims, 7 Drawing Sheets

GREETING CARD WITH GIFT CARD HOLDER

FIELD OF THE INVENTION

The present invention is directed to a greeting card having an integrated holder for presenting a gift card to a recipient.

BACKGROUND OF THE INVENTION

Gift certificates to various stores or restaurants are a popular gift idea for birthdays or the holidays. They allow the sender to give a gift from a store at which the sender knows the recipient enjoys shopping, while relieving the sender of the burden of selecting a specific item of the right size or according to the tastes of the recipient. A gift certificate to a restaurant enables the recipient to enjoy a meal at the selected restaurant with whomever the recipient chooses. Gift certificates may be purchased in incremental amounts as determined by the vendor, or in any amount desired by the purchaser.

In the prior art, gift certificates were essentially a paper-based, printed IOU issued by the store, and coming in a variety of different shapes and sizes, according to the preferences of the vendor. Typically, the gift certificate was presented to the recipient in a matching envelope from the vendor, along with a greeting card appropriate for the occasion as selected by the sender.

Recently, gift certificates have evolved into a form similar to debit cards, having a magnetic stripe, bar code, or other read/write capability. The new generation of gift certificates are more uniformly sized and shaped similarly to credit/debit cards and are "refillable," so as to be reusable by the recipient as an access card for a pre-paid, declining balance-type account. Moreover, the capability to automatically update the value of the card enables the vendor to avoid having to issue a new or replacement certificate, or to cash out any remainder if the recipient does not use the whole amount at once.

SUMMARY OF THE INVENTION

The present invention takes advantage of the more uniform format of gift cards issued by various retail stores and restaurants to provide a convenient, efficient and attractive way to present a recipient with a greeting card suited for the occasion, along with a gift card simultaneously displayed in the greeting card. More particularly, the present invention relates to a greeting card having an integrated gift card holder which eliminates the need to obtain and present the user with both a greeting card and also a separate envelope or other holder or container for a gift card.

The present invention functions as a greeting card, and also includes a gift card holder and a cover which covers a portion of the gift card holder. The gift card holder is movable between a first position relative to the cover when the greeting card is in a closed state, and a second position relative to the cover when the greeting card is in an opened state. When a gift card is placed in the gift card holder, at least a substantial portion of the gift card is displayed to a recipient from behind the cover when the greeting card is opened.

Other features and advantages of the present invention will become apparent from the following description of the invention which refers to the accompanying drawings.

DETAILED DESCRIPTION OF PREFERRED EMBODIMENTS

Figure 1:
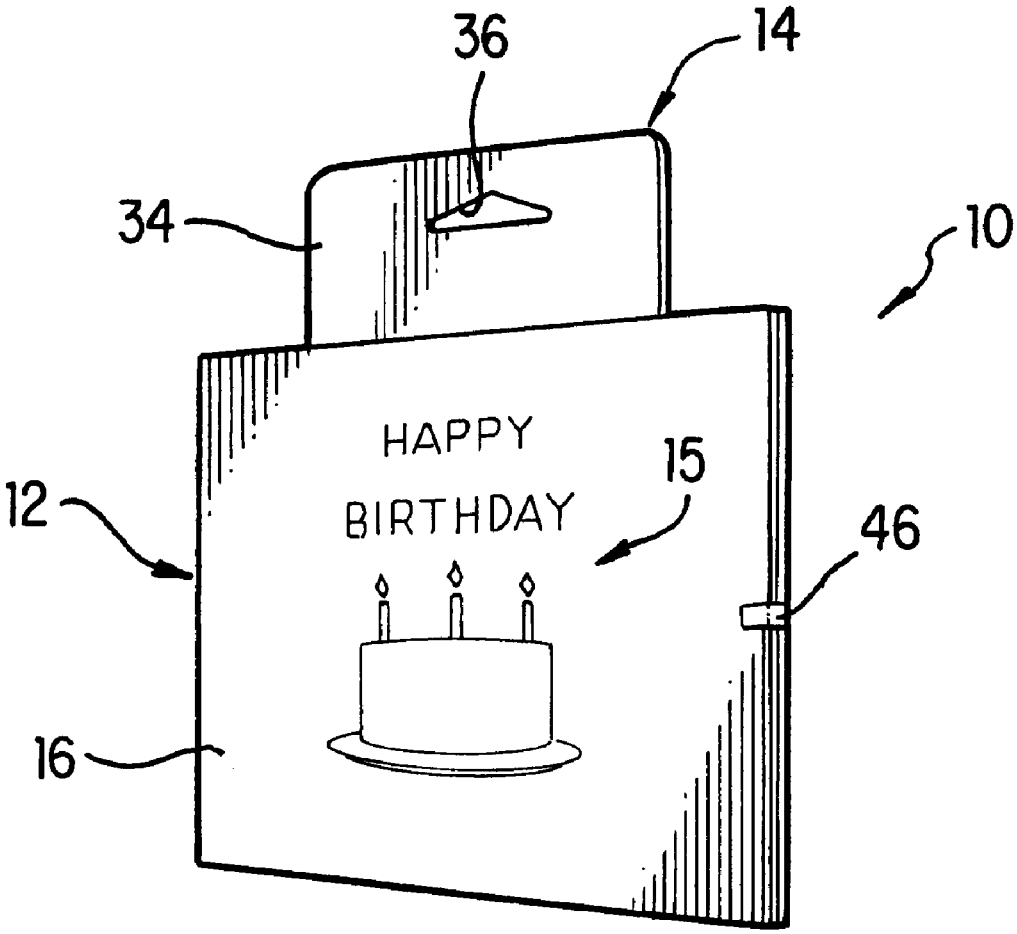
FIG. 1 illustrates an embodiment of the present invention as it may appear in a retail display, showing a closed greeting card attached to a hangar unit for being hung from a display rack.
Figure 2:
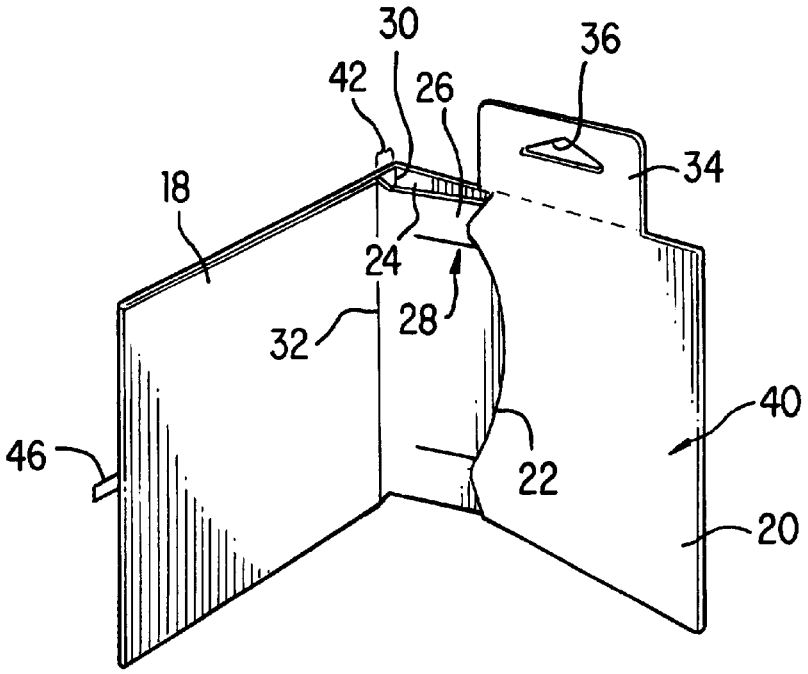
FIG. 2 illustrates the greeting card of FIG. 1 in a partially opened state.

FIG. 1 shows an exemplary embodiment of an integrated greeting card and gift card holder 10 in accordance with the present invention. As seen in FIG. 1, the integrated card 10 includes a greeting card portion 12 and an optional hangar portion 14. Greeting card portion 12 includes a front panel 16, which is printed with words, images, and/or patterns, etc. in various styles as typical on most greeting cards. The printed matter 15 may contain messages or images appropriate for a particular holiday, situation or occasion, i.e., birthday, Christmas, Hanukah, thank you, congratulations, graduation, wedding, new baby, etc. As seen in FIG. 2, front panel 16 is connected to rear panel 24 along central fold line 30. Rear panel 24 may optionally also contain printed matter, as found on many typical greeting cards.

Figure 3:
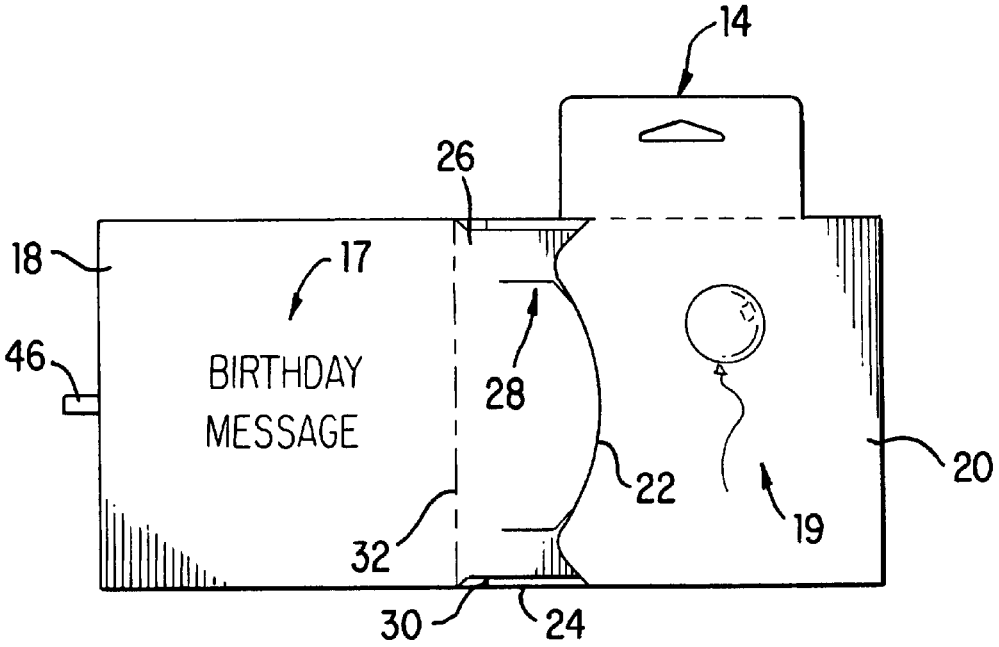
FIG. 3 illustrates the greeting card of FIG. 1 in a fully opened state.

Inside left panel 18, shown in FIGS. 2 and 3, is aligned with front panel 16 and forms the rear surface of front panel 16 and is visible when greeting card 12 is opened. Inside left panel 18 may also contain additional printed text, images, patterns, etc. 17, as determined by the theme of the greeting card content and/or message. Opposite the inside left panel 18 is a pocket 40 formed by inside right panel 20 and rear panel 24. Inside right panel 20 is aligned over rear panel 24 at their respective right edges, as seen in the drawings, and has a left edge 22 significantly short of reaching center fold line 32, to allow room for presentation of a gift card between the left edge 22 of inside right panel 20 and the central fold line 30, as will be described further below. As with inside left panel 18, inside right panel 20 may also contain printed text, images, patterns, etc. 19 related to the greeting card content/message. Preferably, sufficient blank space is provided on inside left panel 18 and/or inside right panel 20 for a handwritten salutation or message from the sender to the recipient.

In this exemplary embodiment, hangar 14 is attached to inside right panel 20 along the top edge thereof. Hangar 14 includes a tab portion 34 with a cutout hole 36 formed therein for hanging the greeting card on a display rack at the retail or vendor location. After purchase by a consumer/sender of the card and before giving the card 12 to a recipient, hangar 14 can be detached from greeting card 12 by tearing along perforated line 38 die cut along the top edge of inside right panel 20.

A gift card panel 26 is connected to inside left panel 18 along interior fold line 32, and is cut away slightly along its top and bottom edges so that gift card panel 26 has a smaller height dimension than that of the inside left panel 18, front panel 16, rear panel 24 and inside right panel 20. The reduced height of gift card panel 26 allows it to easily fit into and slide in and out of pocket 40. Similarly with the other panels, gift card panel 26 may contain decorative or informative print, especially on the portion thereof which remains exposed when the greeting card 12 is opened. Gift card panel 26 includes a gift card holder 28, which in this embodiment is formed by a pair of slits cut into gift card panel 26. As can be seen more clearly in FIGS. 6 and 11, the slits are cut in a manner such that a gift card 44 can be inserted into the slits without slipping through and falling completely behind gift card panel 26.

The interior fold line 32 connecting gift card panel 26 to inside left panel 18 is offset from the central fold line 30 toward the left edge of inside left panel 18. With this configuration, when a gift card 44 is inserted into the holder 28 of the gift card panel 26, most of the gift card 44 will be inserted behind edge 22 and into the pocket 40 when the greeting card 12 is closed. Furthermore, as can be seen in FIGS. 2 and 4 showing the greeting card 12 in a partially opened state, a gap is formed between rear panel 24 and gift card panel 26 due to the offset distance 42 along front panel 16 between center fold line 30 and interior fold line 32.

Optionally, an adhesive strip 46 may be provided for holding the greeting card 12 closed. Other materials or mechanisms may alternatively be used to maintain closure of the greeting card 12 until desired to be opened. Examples include any of various types of light, resealable and/or removable adhesives spot applied on one or both of inside left and right panels 18, 20 near the peripheral edge thereof, and fasteners such as Velcro®, snaps, etc.

Figure 4:
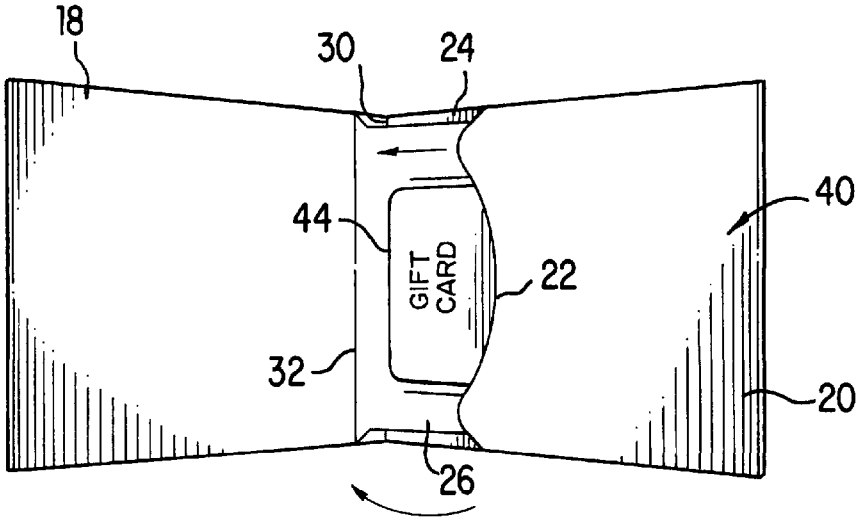
FIG. 4 is an exemplary greeting card of the present invention containing a gift card in the holder thereof, as shown in a partially opened state.
Figure 5:
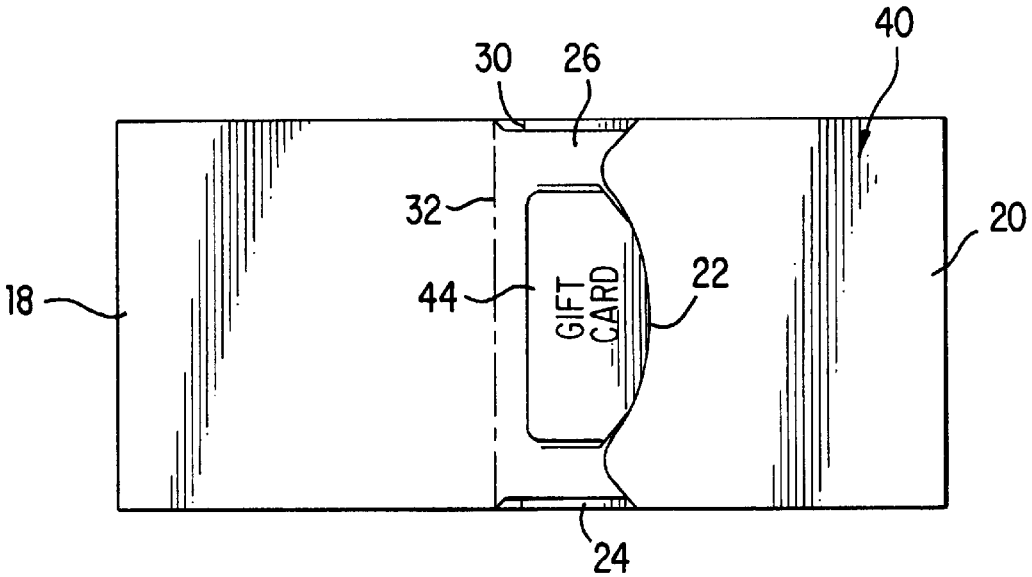
FIG. 5 illustrates the greeting card of FIG. 4 showing a gift card displayed therein with the greeting card in a fully opened state.

FIG. 4 shows a greeting card 12 containing a prepaid gift card 44 in a partially opened state, as may be viewed by a recipient. As the greeting card 12 is opened by rotating front panel 16 and inside left panel 18 about the axis of central fold line 30, the offset distance 42 of the interior fold line 32 from the central fold line 30 causes the gift card panel 26 to slide partially out of pocket 40. The gift card 44 thus "pops out" from behind the edge 22 of inside right panel 20 so that a significant portion of the gift card 44 is displayed to the recipient, as seen in FIG. 5. The movement of the gift card 44 out of the pocket 40 as the greeting card 12 is opened provides an eye-catching effect and serves similarly to an "unwrapping" of the gift. In the illustrated embodiment, at least about half of the gift card 44 extends outward and is exposed to the recipient when the greeting card is opened, although the exposed amount may be greater or lesser as desired by the manufacturer. This relationship is important because it provides the desired balance between providing a sufficient amount of the card 44 to be recognized, while keeping enough of the card 44 in the pocket 40 to provide stability. Similarly, upon closing the greeting card 12, the gift card panel 26, and hence gift card 44, slides back into pocket 40.

Figure 6:
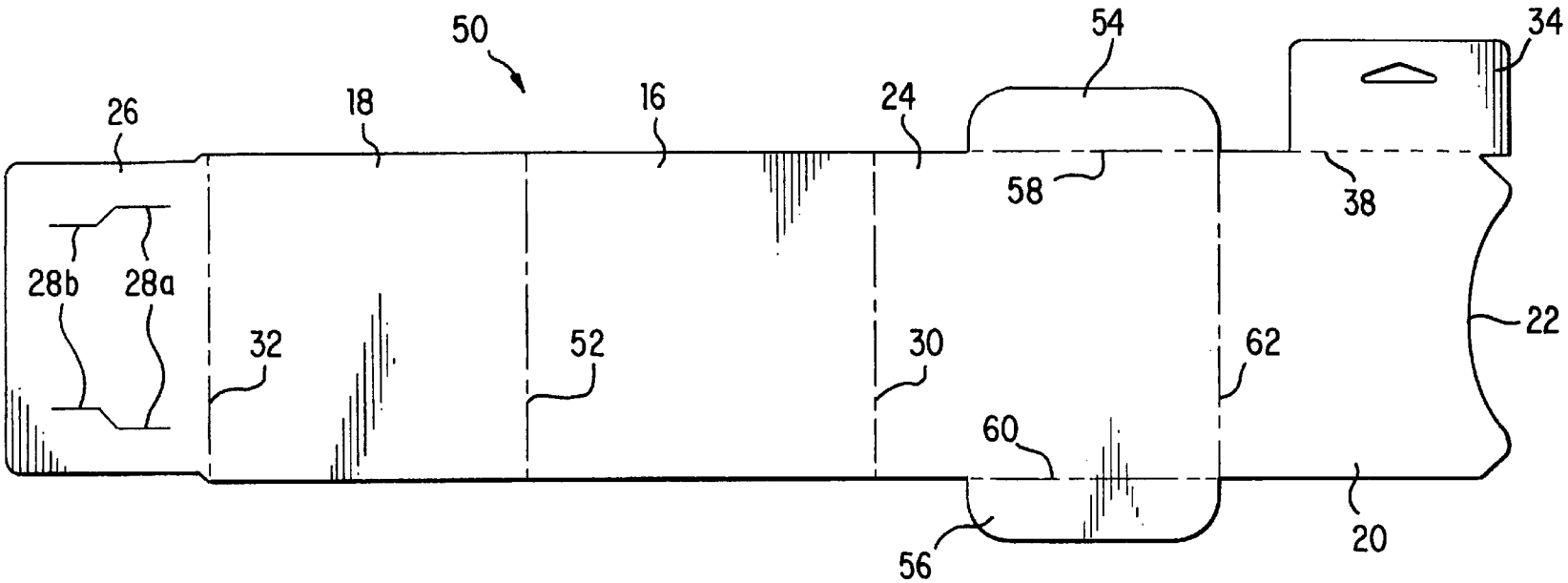
FIG. 6 shows an unassembled blank of the integrated greeting card and gift card holder of the present invention.

Next, a description will be provided of the integrated greeting card and gift card holder 10 of the present invention in an unassembled state, and a process for assembling the integrated greeting card and gift card holder 10 from a blank 50, shown in FIG. 6.

Blank 50 is preferably made from a cardboard or paperboard material, such as those typically used for making greeting cards, or from a light plastic material, and includes gift card panel 26 adjoining a first side of inside left panel 18 along interior fold line 32; a first side of front panel 16 adjoining a second side of inside left panel 18 along a front exterior fold line 52; a first side of rear panel 24 adjoining a second side of front panel 16 along central fold line 30; a first side of inside right panel 20 adjoining a second side of rear panel 24 along a rear exterior fold line 62; first and second flaps 54 and 56 adjoining third and fourth sides of rear panel 24, respectively, along first and second flap fold lines 58 and 60, respectively; and hangar tab 34 adjoining a second side of rear panel 24 along perforated line 38.

In this exemplary embodiment, gift card panel 26, inside left panel 18, front panel 16, rear panel 24, and inside right panel 20 are arranged linearly, as seen in FIG. 6. With this configuration, only one side of the blank 50 needs to be printed to provide text, images, etc. on the viewable sides of all the panels of the assembled product. For example, with a linear configuration, the printed matter 15, 17 and 19 on panels 16, 18 and 20, respectively, can all be printed on the same side of the blank 50.

Other configurations are possible, however, and are within the scope of the present invention. For example, inside left panel 18 (and hence front exterior fold line 52) may be formed to adjoin front face panel 16 along either the top edge or the bottom edge of the latter, according to the orientation shown in the drawing, instead of along the left side thereof. With such an alternative configuration, gift card panel 26 would adjoin inside left panel 18 along the right side of the latter, so as to be oriented properly upon assembly of the blank 50.

In another alternative configuration, inside right panel 20 may be formed to adjoin rear panel 24 along either the top edge or the bottom edge of the rear panel 24, according to the orientation shown in the drawing, instead of along the right side thereof. As such, one of first and second flaps 54, 56 would be formed to adjoin either rear panel 24 along the right edge thereof, as seen in the drawing, or inside right panel 20 along any available edge thereof, other than edge 22. Moreover, hangar tab 34 may be formed to adjoin any available edge of inside left panel 18, front panel 16, rear panel 24, or inside right panel 20 other than edge 22.

Further alternative configurations may be provided in which first and second flaps 58, 60 may be formed to adjoin any combination of edges among the top and bottom edges of rear panel 24 and inside right panel 20, according to the orientation shown in FIG. 6, and/or hangar tab 34 may be formed to adjoin an available upper or lower edge of any of panels 16, 18, 20, and 24. Further still, other combinations of the configurations described hereinabove may be used, as especially where the blank can be assembled into the integrated greeting card and gift card holder 10 shown in FIG. 1, with the same functional aspects described above.

Figure 7:
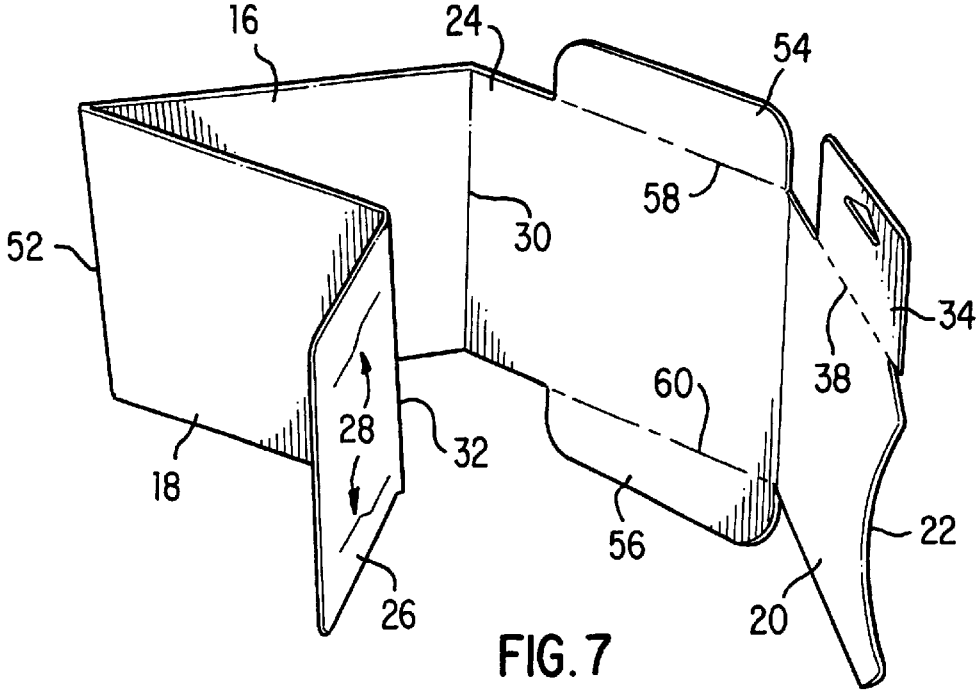
FIG. 7 illustrates a step in the process of assembling/folding the blank shown in FIG. 6 to obtain the integrated greeting card and gift card holder shown in FIG. 1.
Figure 8:
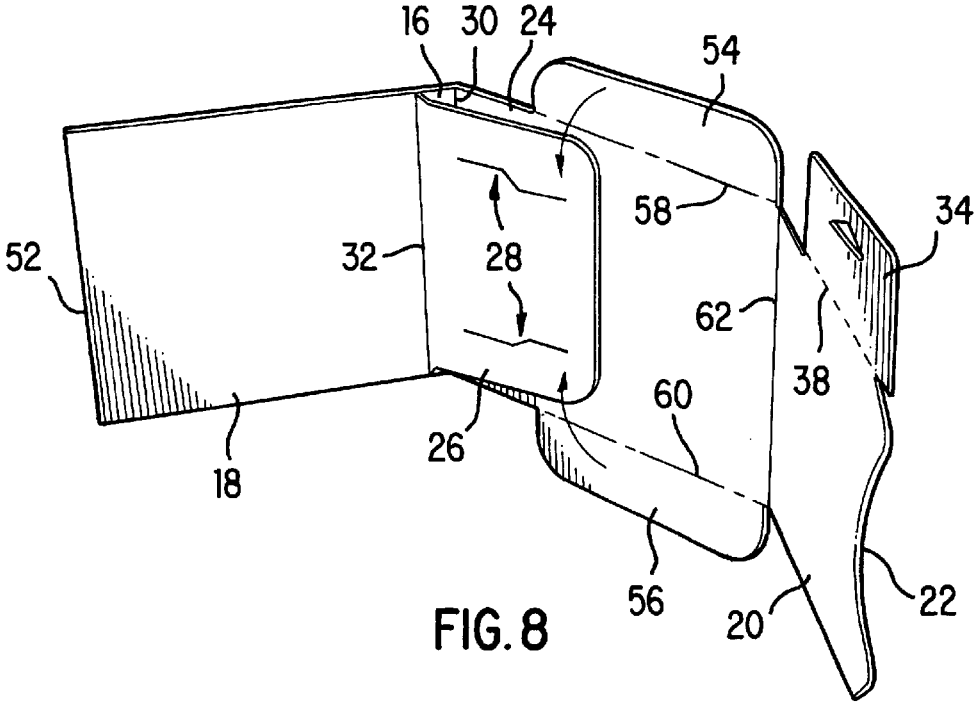
FIG. 8 illustrates a step in the process of assembling/folding the blank shown in FIG. 6 subsequent to the step illustrated in FIG. 7.

When starting with the blank 50 shown in FIG. 6, the integrated greeting card and gift card holder 10 is formed by first folding along front exterior fold line 52 to bring inside left panel 18 into contact with front panel 16, as shown in FIG. 7. As seen in FIG. 8, inside left panel 18 and front panel 16 are aligned along the front exterior fold line 52, and their upper and lower edges. The right edge of front panel 16 corresponds with central fold line 30, and extends past the right edge of inside left panel 18, which corresponds with the interior fold line 32. Optionally, the two panels may be sealed together with an adhesive applied to one or both confronting surfaces of the two panels 16 and 18.

Figure 9:
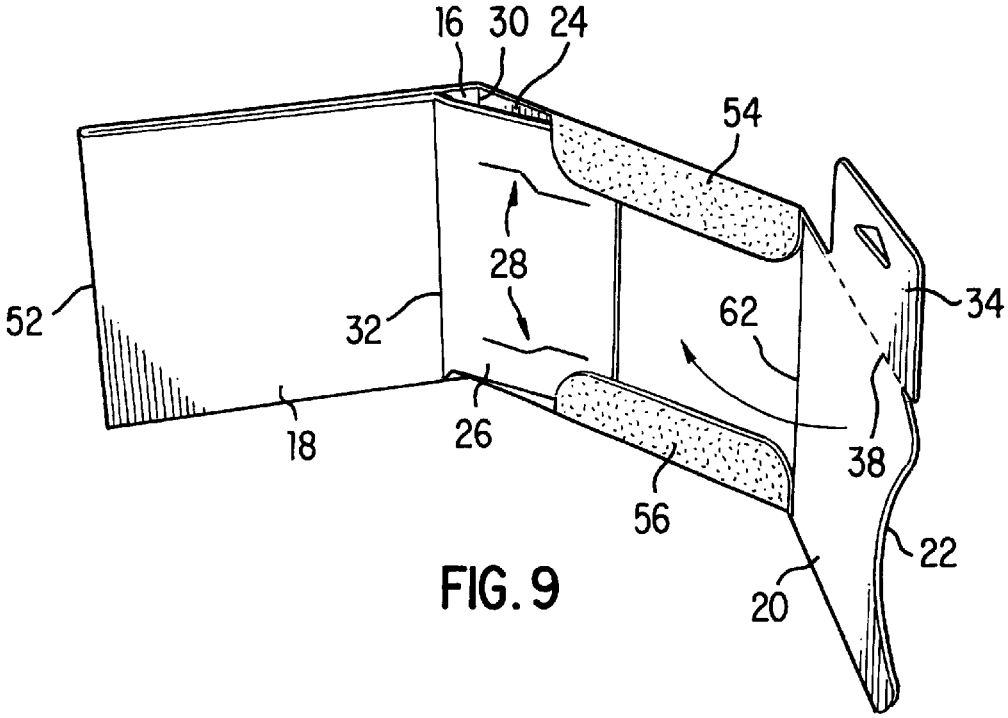
FIG. 9 illustrates a step in the process of assembling/folding the blank shown in FIG. 6 subsequent to the step illustrated in FIG. 8.

Next, with the gift card panel 26 overlapped onto rear panel 24, flaps 54 and 56 are folded along flap fold lines 58 and 60, respectively, so as to overlap the corners of gift card panel 26, as illustrated in FIGS. 8 and 9. An adhesive is then applied to the surfaces of flaps 54, 56 which face away from gift card panel 26 (FIG. 9).

Figure 10:
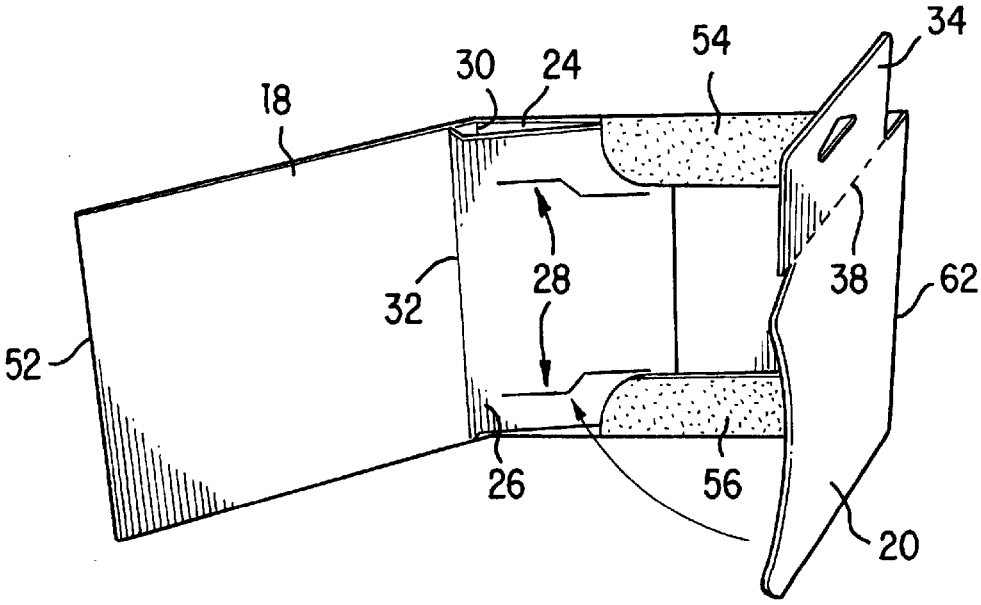
FIG. 10 illustrates a step in the process of assembling/folding the blank shown in FIG. 6 subsequent to the step illustrated in FIG. 9.

Inside right panel 20 is then folded toward gift card panel 26 along rear exterior fold line 62, as shown in FIG. 10, and is secured in place upon contact with the adhesive-coated flaps 54 and 56, to thereby form pocket 40. Assembled in this manner, the blank 50 is transformed into the integrated greeting card and gift card holder 10. Similar assembly operations are performed with the various alternative collapsed configurations to obtain similar integrated greeting card and gift card holders in accordance with the present invention.

As mentioned above, gift card panel 26 is smaller in height than adjoining inside left panel and rear panel 24 such that gift card panel 26 appears to have been cut away along both its top and bottom edges thereof. Also, the width of gift card panel 26 is substantially less than the width of rear panel 24, such that when the greeting card 12 is in a closed position, only approximately one-half of gift card panel 26 is inserted behind the flaps 54 and 56, and edge 22 of pocket 40. The reduced height and width of the gift card panel 26 allows the panel 26 to move with relative ease back and forth in the pocket 40 upon opening and closing the card 12, by reducing the potential for the edges of gift card panel 26 being hindered by frictional resistance in the creases along fold lines 58 and 60.

Gift card panel 26 is not necessarily permanently retained inside pocket 40 during the assembly of the invention. Optionally, pocket 40 may be formed while the gift card panel 26 is positioned outside thereof, and may be later inserted into the pocket at the time a gift card is to be placed in the holder 28. Similarly, depending on the dimensions of the gift card panel 26 relative to the depth of pocket 40 as well as the ease of insertion of a gift card into holder 28, the gift card panel 26 may be removed from pocket 40 for inserting a gift card therein, and then reinserted into the pocket thereafter. Removal of the gift card panel 26 from the pocket 40 or providing an assembled greeting card and gift card holder with the gift card panel 26 outside the pocket 40, however, is more feasible when the dimensions of gift card panel 26 are such that the gift card panel 26 extends only shallowly into the pocket 40 when inserted therein.

Figure 11:
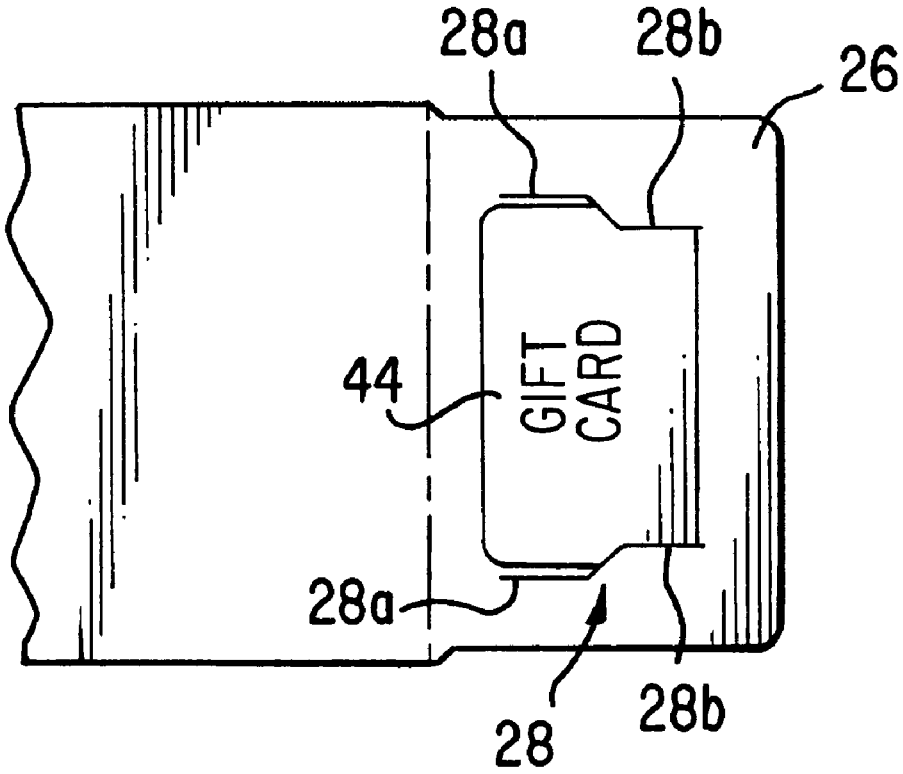
FIG. 11 shows the gift card holder portion of the greeting card according to the present invention, with a gift card being held therein.

In the preferred embodiment, gift card holder 28 is formed in gift card panel 26 as a pair of slits die cut through the panel 26. As can be seen in FIG. 6, inter alia, the slits are formed as a pair of substantially parallel cuts having a portion 28*a* spaced apart to the same width as or slightly wider than the width of a standard credit card-sized gift card, and then tapering together to a second parallel portion 28*b* which is spaced apart to a width narrower than the width of the gift card. FIG. 11 shows a gift card 44 inserted into the slits of holder 28, with the lower corners of the card 44 placed behind the narrower second portion 28*b*, and the remainder of the card 44 positioned on the front surface of panel 26. The gift card crosses from being behind the gift card panel 26 to being on the front surface of the panel 26 at the ends of the slits at portion 28*b*. Thus, gift card 44 is prevented from slipping completely through the slits to fall behind the gift card panel 26.

The slits forming holder 28 may be formed according to other shapes, as desired. For example, the holder may be formed as a pair of short diagonal cuts through which the bottom corners only of a gift card 44 can be inserted. Alternatively, holder 28 may be formed as other embodiments entirely, such as a shallow pocket or transparent sleeve attached to the surface of gift card panel 26.

In the exemplary embodiment described herein, the pocket 40 is formed at the right side of the opened greeting card. This is the preferred arrangement for a typical greeting card in which the front panel opens like a book toward the left, because it produces a dynamic effect which is more noticeable to the recipient when the greeting card is opened. However, the integrated greeting card and gift card holder of the present invention also encompasses variations of the disclosed embodiment in which the pocket and gift card holder is provided on the left side of the opened card. The present invention further encompasses greeting cards which open vertically, in which the pocket and gift card holder is provided preferably in the upper portion, but alternatively in the lower portion of the opened card. Of course, for each of these variations, corresponding changes to the unassembled blank may be made, while still preserving the function of a "pop-out" display of a gift card. Further still, although the embodiment discussed herein is shown in the drawings as a greeting card which is substantially square in shape, the greeting card may be formed to be of other shapes and sizes as designed, with the unassembled blank designed accordingly to be assembled in a similar manner and to function as described herein.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed as new and desired to be protected by Letters Patent of the United States is:

1. An integrated greeting card and gift card holder, comprising:

a first exterior panel;

a second exterior panel having a width equal to that of said first exterior panel, a first side of said first exterior panel being connected to a first side of said second exterior panel along a central fold line;

a first interior panel having a first side thereof connected to a second side of one of the first exterior and second exterior panels, said first interior panel being additionally attached to said one of the first and second exterior panels along additional sides or peripheral edges of the latter, so as to form a pocket with said one of the first and second exterior panels;

a second interior panel connected along a first side thereof to the other of the first and second exterior panels along a second side thereof, said second interior panel having a width slightly less than that of said other of the first and second exterior panels, said second interior panel being overlaid onto said other of the first and second exterior panels so that when said first and second exterior panels are folded along said central fold line, said first interior panel faces said second interior panel; and a gift card panel connected to a second side of said second interior panel along an interior fold line which is offset from said central fold line, wherein said gift card panel is insertable into said pocket, is movable between a first position when the first and second exterior panels are disposed relative to each other in a closed position and a second position when the first and second exterior panels are disposed relative to each other in an open position, and includes a gift card holder.

2. The integrated greeting card and gift card holder according to claim 1, wherein the gift card panel has a height which is less than that of the first and second exterior panels.

3. The integrated greeting card and gift card holder according to claim 1, wherein the holder is formed by slits cut into the gift card panel.

4. The integrated greeting card and gift card holder according to claim 1, further comprising a hangar tab detachably formed along one side of any of the first or second exterior panels or of the first or second interior panels.

5. The integrated greeting card and gift card holder according to claim 1, further comprising printed matter on at least one of said first exterior panel, said second exterior panel, said first interior panel, said second interior panel, and said gift card panel.

6. A gift package, comprising:

a greeting card;

a gift card holder integrally formed with said greeting card and including securing means for securely retaining a gift card on said gift card holder; and a cover integrally formed with said greeting card for at least partially covering said gift card holder, wherein said gift card holder is movable between a first position when said greeting card is in a closed state and a second position when said greeting card is in an opened state, such that when a gift card is secured on said gift card holder, said gift card holder is placed behind said cover and said greeting card is opened, the gift card is displayed from behind said cover.

7. The gift package according to claim 6, wherein said securing means includes at least one slit cut into the gift card holder such that a gift card can be inserted into said at least one slit to securely hold the gift card in said gift card holder.

8. The gift package according to claim 6, wherein the cover is formed as a pocket, and wherein the gift card holder slidable in and out of said pocket.

9. The gift package according to claim 6, further comprising a detachable tab attached to said greeting card for mounting the gift package on a display device.

10. A gift package, comprising:

a front panel;

a rear panel connected to said front panel along a central fold line;

a gift card holder connected to one of said front and rear panels at a location offset from said central fold line, said gift card holder including means for securely retaining a gift card on said gift card holder;

a cover provided on the other of said front and rear panels, said cover being sized and shaped to cover at least a portion of said other of said front and rear panels so that at least a portion of said gift card holder is insertable behind said cover;

wherein said gift card holder is moveable between a first position relative to said cover when said at least a portion of said gift card holder is inserted behind said cover and said front panel is substantially superposed over said rear panel, and a second position relative to the cover when said at least a portion of said gift card holder is inserted behind said cover and said front panel is substantially juxtaposed with said rear panel along said central fold line.

11. The gift package according to claim 10, wherein said securing means includes at least one slit cut into the gift card holder such that a gift card can be inserted into said at least one slit to securely hold the gift card in said gift card holder.

12. The gift package according to claim 10, wherein said gift card holder is slidable between said first and second positions.

13. The gift package according to claim 10, wherein the cover forms a pocket with said other of said front and rear panels.

14. The gift package according to claim 10, wherein when a gift card is placed into said gift card holder, said gift card is more exposed relative to said cover when said gift card holder is in said second position than when said gift card holder is in said in first position.

15. The gift package according to claim 10, further comprising a detachable tab attached to one of said front panel, said rear panel, and said cover.

16. A blank to be assembled into a combined greeting card and gift card holder, comprising a first exterior panel having a width extending from a central fold line in the blank to a first edge fold line in the blank;

a second exterior panel adjoining said first exterior panel along said central fold line and having a width equal to the width of said first exterior panel, the width of said second exterior panel extending from said central fold line to a second edge fold line in the blank;

a first inside panel adjoining said first exterior panel with one side thereof aligned with said first edge fold line, said first inside panel having a width less than that of said first exterior panel and extending from said first edge fold line to an interior fold line;

a gift card panel adjoining said first inside panel along said interior fold line, said gift card panel including a holder for holding a gift card;

a second inside panel adjoining said second exterior panel with one side thereof aligned with said second edge fold line, said second inside panel having a width substantially less than that of said second exterior panel; and means for facilitating securement of said second inside panel to said second exterior panel so as to form a pocket for covering at least part of said gift card panel.

17. The blank according to claim 16, wherein the blank is configured such that said gift card panel, said first inside panel, said first exterior panel, said second exterior panel, and said second inside panel are linearly and sequentially arranged in that order.

18. The blank according to claim 16, wherein the means for facilitating securement comprises first and second flaps each adjoining one of said second exterior panel and said second inside panel.

19. The blank according to claim 16, further comprising a hangar tab detachably connected to any of said first exterior panel, second exterior panel, first inside panel, or second inside panel.

20. The blank according to claim 16, further comprising printed matter on at least one of said first exterior panel, said second exterior panel, said first inside panel, said second inside panel, and said gift card panel.

21. The blank according to claim 20, wherein said first exterior panel, said second exterior panel, said first inside panel, said second inside panel, and said gift card panel are arranged in a configuration such that only one side of the blank needs to be printed to provide said printed matter so as to be viewable on the relevant panel or panels when the blank is in an assembled state.

* * * * *